US007724192B2

(12) United States Patent
Liu

(10) Patent No.: US 7,724,192 B2
(45) Date of Patent: May 25, 2010

(54) PORTABLE COMMUNICATION DEVICE WITH SLOT-COUPLED ANTENNA MODULE

(75) Inventor: I-Ru Liu, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 198 days.

(21) Appl. No.: 11/802,027

(22) Filed: May 18, 2007

(65) Prior Publication Data

US 2008/0001837 A1 Jan. 3, 2008

(30) Foreign Application Priority Data

Jul. 3, 2006 (TW) ..... 95124188 A

(51) Int. Cl.
*H01Q 1/38* (2006.01)

(52) U.S. Cl. ..... 343/700 MS; 343/829; 343/846

(58) Field of Classification Search ..... 343/700 MS, 343/705, 767, 789, 829, 830, 846, 848, 872
See application file for complete search history.

(56) References Cited

U.S. PATENT DOCUMENTS 5,706,015 A * 1/1998 Chen et al. ..... 343/700 MS
6,188,369 B1 * 2/2001 Okabe et al. ..... 343/767
6,239,750 B1 * 5/2001 Snygg ..... 343/700 MS
6,989,793 B2 * 1/2006 Van Der Poel ..... 343/700 MS
7,358,920 B2 * 4/2008 Apostolos et al. ..... 343/789
7,389,129 B2 * 6/2008 Shoji ..... 455/575.5
7,391,381 B2 * 6/2008 Wang et al. ..... 343/713
7,471,248 B2 * 12/2008 Popugaev et al. ..... 343/700 MS
2007/0296634 A1 * 12/2007 Popugaev et al. ..... 343/700 MS

* cited by examiner

*Primary Examiner*—Douglas W Owens
*Assistant Examiner*—Chuc D Tran
(74) *Attorney, Agent, or Firm*—Bacon & Thomas, PLLC

(57) ABSTRACT

The present invention discloses a portable communication device with slot-coupled antenna module the slot-coupled antenna module comprises: a dielectric substrate, radio module, ground plane, air substrate, and patch radiator. The radio module contains a feed line and stub that are coupled on the surface of the dielectric substrate and extending along the long side of the dielectric substrate in parallel. The ground plane with slot-coupled structure is coupled on the other surface of the dielectric substrate, the feed line and stub pass through the intersect portion of the coupled slots. The air gap is therefore formed between the ground plane and the patch radiator, and the patch radiator is substantially parallel with the ground plane and locating substantially on the position of the coupled slots.

18 Claims, 14 Drawing Sheets

PORTABLE COMMUNICATION DEVICE WITH SLOT-COUPLED ANTENNA MODULE

FIELD OF THE INVENTION

The present invention is related to a hand-held communication device, particularly to a hand-held communication device with slot-coupled antenna module.

BACKGROUND OF THE INVENTION

For the development of technology and progress of communication, people could never be stratified with the wired network again. Besides, the users of wireless network keep increasing with the popularization of mobile devices, such as the mobile phone, the notebook and the PDA.

WiFi, provided by Wireless Ethernet Compatibility Alliance (WECA), also the alternative name of IEEE 802.11, is a short range communication technique, which could support the network receiving frequency signals within several hundreds feet. Such type of technique might be realized easily in high speed network. With the prompt progress in communication technology as well as the coming of standards IEEE 802.11a,b,g and n, a great amount of wireless radio frequency techniques have been proposed and utilized. However, the standardization is accelerated since the users of the wireless network are quickly raised. In view of the application, all of the ordinary hand-held communication devices are required to be compatible with the 802.11 devices.

The wireless RF and antenna modules are usually included in the hand-held communication devices that are capable of providing 802.11 communication functions, such as PDA, mobile phone, portable media player, game console and other communication devices supporting WiFi protocol. In general, the antenna module includes a conductive patch radiator for promoting radio efficiency. The conductive patch radiator is conventionally: (1) attached or printed inside or outside the dielectric housing; (2) built in the dielectric housing; or (3) sandwiched or stacked up to be the inner layer of the two outer layers of the dielectric housing.

The feed line or short conductor connecting the radiator and the radio module on the PCB is absent in above antenna module. In addition, the radio module is usually constituted with the discrete or integrated circuits.

There are following disadvantages in traditional antenna:

(1) Common antenna is directly fixed or connected on the PCB. Therefore, the performance of the antenna will be influenced or interference by other components on the PCB, such as the battery, the keyboard, the LCD panel, the connector, the speaker, the lens, the microphone, the push bottom switch, the wire harness and the LED.

(2) The antenna is usually directly disposed on the housing, and connected to the PCB by the cable or adapter. Consequently, there would be shortcomings, such as cable loss of transmission, non-reliability of cable connection, and difficult assembling and trouble-shooting.

(3) Since the antenna is disposed outside the housing, the cable or adapter through the housing is utilized to connect the antenna to the PCB. Accordingly, the signals would lose or the surface of housing would be rugged and rough.

(4) Since the antenna is disposed in a standalone and outside the housing, the cable or adapter through the housing is utilized to connect the antenna to the PCB. Accordingly, the signals would lose and better mounting knowledge is required.

In conclusion, an improved hand-held communication device should be provided to rid of these disadvantages.

SUMMARY OF THE INVENTION

In view of aforementioned problems of prior art, the present invention therefore provides a portable communication device with slot-coupled antenna module and such portable communication device is particularly compatible with WiFi standard and protocol.

The advantage of the present invention is that the portable communication device has the antenna with slot-coupled structure. Since the inner space is more flexible than that of prior art, the antenna could fix stably within the portable communication device.

Another advantage of the present invention is that the slot-coupled antenna provides better radiation efficiency so that the radiation gain could be remarkably improved.

Still another advantage of the present invention is that the bandwidth and return loss of the X-shaped or 8-shaped slot-coupled antenna is much wider and greater than that of conventional I-shaped slot-coupled antenna. Besides, the radiation efficiency of the antenna in the present invention could compete with that of popular H-shaped slot-shaped antenna.

The main purpose of the present invention is providing a portable communication device with a slot-coupled antenna module and the device comprises: a radio module on a dielectric substrate, which could be a PCB, within the portable communication device for processing wireless signals; an X-shaped or 8-shaped slot-coupled antenna on the dielectric substrate, wherein a feed line and a stub substantially pass through an intersection point of the X-shaped or 8-shaped slot-coupled antenna, and an included angle of the X-shaped or 8-shaped slot-coupled antenna is substantially 60 degrees; a patch radiator, which could be a metal plate, substantially deposited on the position of the X-shaped or 8-shaped slot-coupled antenna and parallel with the X-shaped or 8-shaped slot-coupled antenna, wherein an air stratum is formed therebetween as a resonant cavity; and a ground plane on the dielectric substrate. The slot-coupled antenna model might be deposited in a dielectric housing, and the patch radiator is coupled to an inner surface of the dielectric housing.

Another purpose of the present invention is providing a slot-coupled antenna module which comprises: a ground plane coupled to a dielectric substrate; an 8-shaped or X-shaped coupled slot, wherein a feed line and a stub substantially pass through an intersection point of the 8-shaped or X-shaped coupled slot; and a patch radiator, substantially deposited on the position of the 8-shaped or X-shaped coupled slot.

DETAILED DESCRIPTION OF THE PREFERRED EMBODIMENT

The present invention is described with the preferred embodiments and accompanying drawings. It should be appreciated that all the embodiments are merely presented for illustration. Although the present invention has been described in terms of a preferred embodiment, the invention is not limited to these embodiments. The scope of the invention is defined by the claims. Modifications within the spirit of the invention will be apparent to those having ordinary skill in the art.

Figure 1:
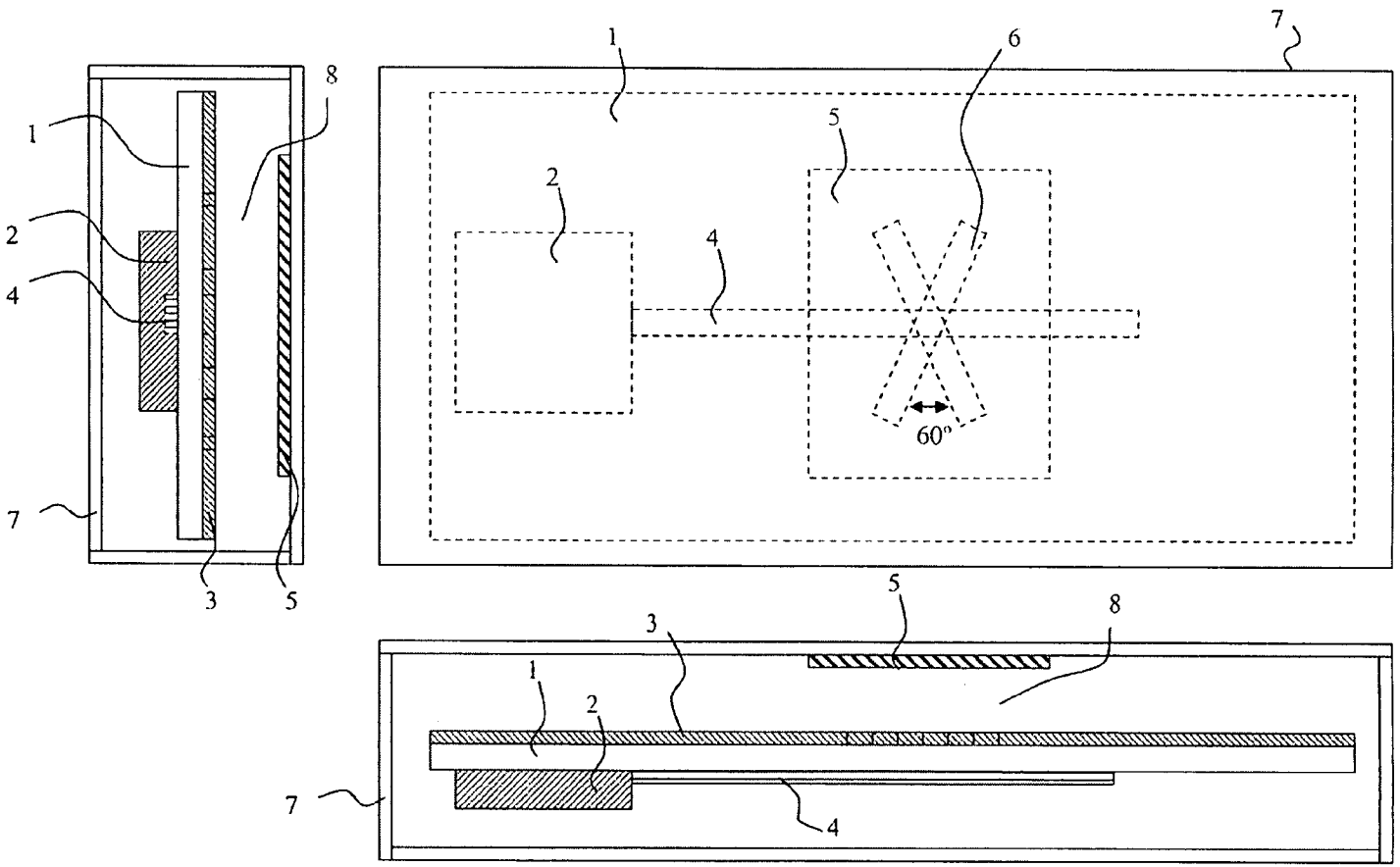
FIG. 1 presents three views of the hand-held communication device according to the preferred embodiment of the present invention.

An x-shaped or 8-shaped slot-coupled antenna is disclosed to be adopted in the communication device compatible with the WiFi standard and protocol. FIG. 1 presents three views of the portable communication device of the preferred embodiment of the present invention. Such portable communication device comprises a dielectric substrate 1, a radio module 2, a ground plane 3, a feed line 4, a patch radiator 5 and an x-shaped coupled slot 6. The antenna is deposited within a dielectric housing 7, and the dielectric substrate 1 generally is a PCB with various electronic components and control circuits, which would be detailed in following description.

As shown in the top view and side view in FIG. 1, the radio module is coupled on the surface of dielectric substrate. In one embodiment of the present invention, the feed line 4 is coupled to the dielectric substrate 1 on the same side with the radio module 2. One terminal of the feed line 4 coupled to the radio module 2, and the feed line 4 extends substantially toward the long axis of the dielectric substrate. Usually, the feed line 4 includes the stub, and the feed line feeds signals into the radio module 2.

The ground plane 3 is coupled to the dielectric substrate on the side other than that with radio module 2. The ground plane 3 has the size substantially equal to that of the dielectric substrate, and generally constituted with conducting material, such as metal plate, for ground. As shown in the front view in FIG. 1, the X-shaped coupled slot is formed on the ground plane 3, and the feed line 4 passes through the intersection point of this X-shaped coupled slot. Normally, the feed line 4 is a transmission line for transferring radio-frequency signals.

The patch radiator 5 is coupled to the inner surface of the dielectric housing 7, and has the area slightly greater than that of the X-shaped coupled slot 6. Beside, the patch radiator 5 is deposited substantially on the position of the X-shaped coupled slot 6. In general, the patch radiator 5 is constituted with a conducting plate, such as a metal plate, for transmitting signals. It has to be noted, an air gap 8 is thereby formed between the X-shaped coupled slot 6 and the patch radiator 5 and it is employed as the resonant cavity for radiating the radio-frequency signals.

The following data is demonstrated merely for illustration, instead of limitation. In the preferred embodiment of the present invention, the area of the patch radiator 5 is about $12.4\times22$ mm$^2$, the height of the dielectric housing 7 is about $0.747\pm0.0375$ mm, and the thickness of the air gap 8 is about $6\pm0.3$ mm. In addition, the area of the feed line is preferably about $20\times1$ mm$^2$, and the area of the stub of the feed line 4 is preferably about $7.4\times1$ mm$^2$. The dimension of the dielectric substrate 1 is about $50\times25\times0.747$ mm$^3$ and the dielectric constant of the dielectric substrate 1 is about 4.2. The area occupied by the ground plane 3 is about $50\times25$ mm$^2$, the area of the coupled slot 6 is $1\times10$ mm$^2$, and the included angle of the coupled slot is substantially around 60 degrees.

In the preferred embodiment of the present invention, the dimension of the metallic shield of the radio module 2 is about $10\times10\times1.5$ mm$^3$. Moreover, the thickness of the patch radiator 5 is about 1.4 mils per ounce metallic foil, and the thickness of the feed line 4, the stub and the ground plane 3 is about 0.7 mils per 0.7 ounce metallic foil. The dielectric constant of the substrate 1 is about 4.2, typically, the dielectric constant of the air is about 1.0 and of the dielectric housing 7 is about 3-6.

Figure 3:
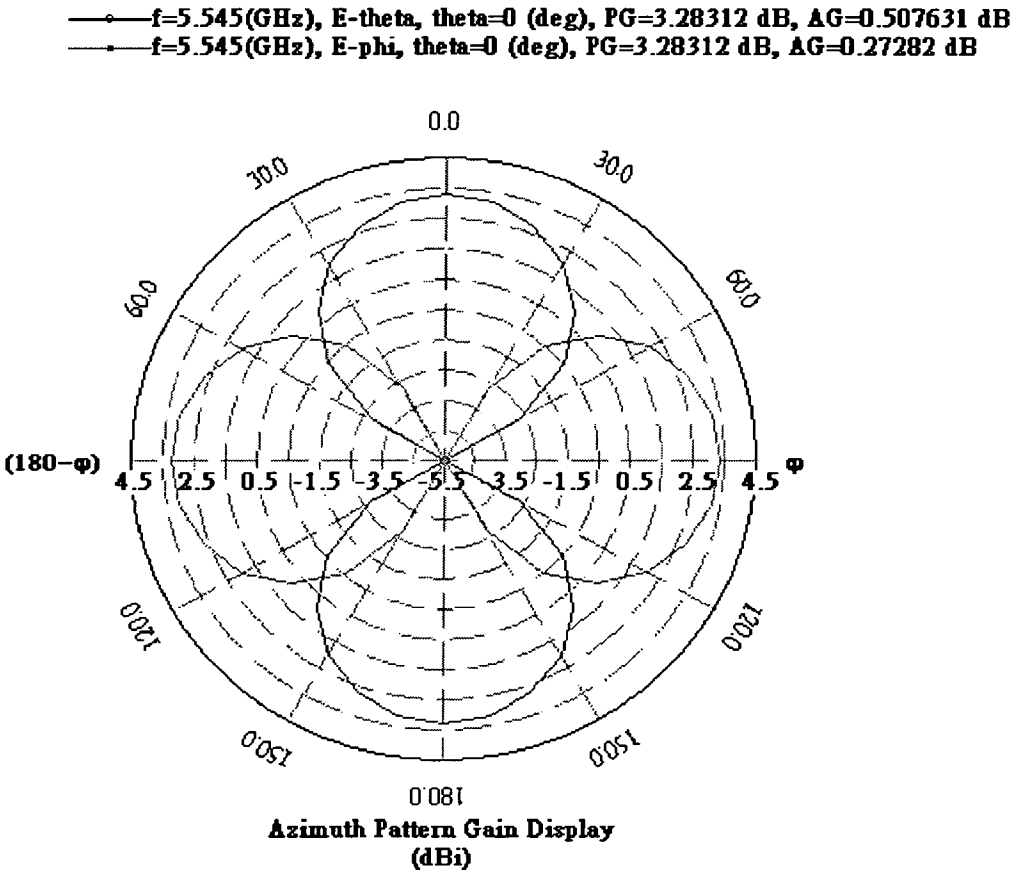
FIG. 3 is the azimuth field pattern of the electric field distribution of the first embodiment.
Figure 4:
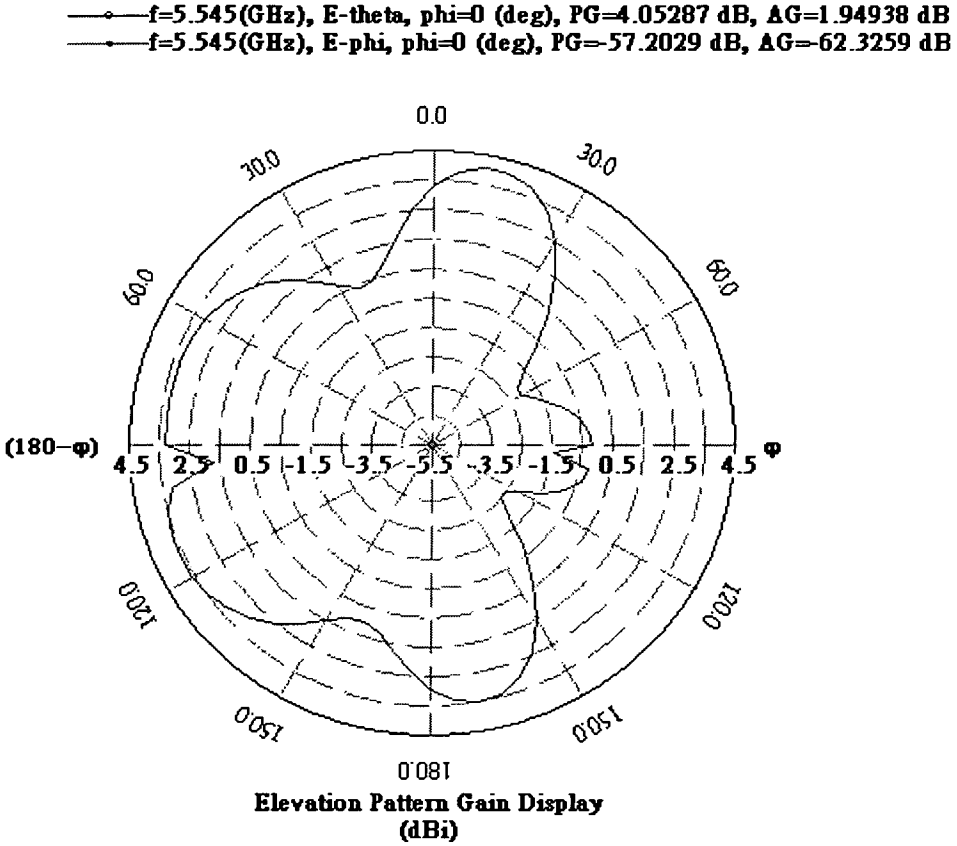
FIG. 4 is the elevation field pattern of the electrical field distribution while $\phi$ equals 0 of the first embodiment.
Figure 5:
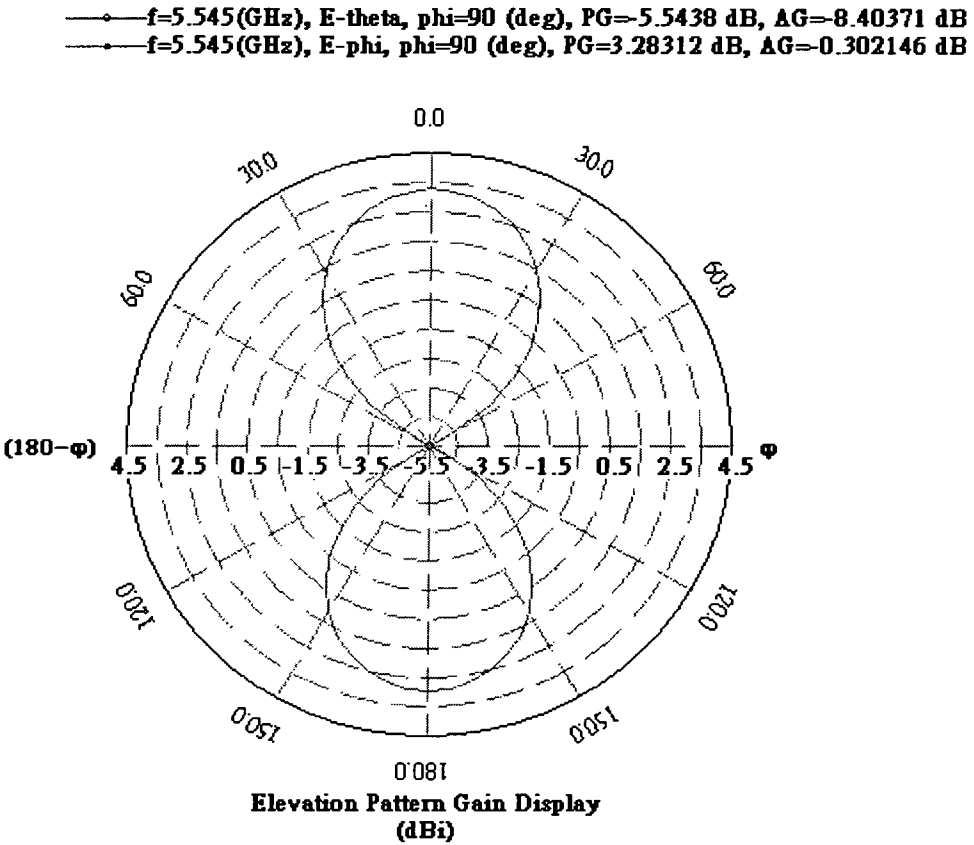
FIG. 5 is the elevation field pattern of the electrical field distribution while $\phi$ equals 90 degrees of the first embodiment.

FIG. 3 is the Azimuth pattern of the electric field of the present embodiment. FIG. 4 and FIG. 5 is the elevation pattern of the electric field of the present embodiment, wherein ϕ equals 0 or 90 degrees, respectively. In the present antenna, when ϕ of E-theta equals 0, the peak gain thereof would be about 4.05287 dB. However, when ϕ of E-theta equals 90 degrees, the peak gain thereof would be about 3.28312 dB. Besides, the average gain is about 1.94938 dB as ϕ of E-theta equals 0, and the average gain is about −0.3202146 dB as ϕ of E-theta equals 90 degrees.

Figure 6:
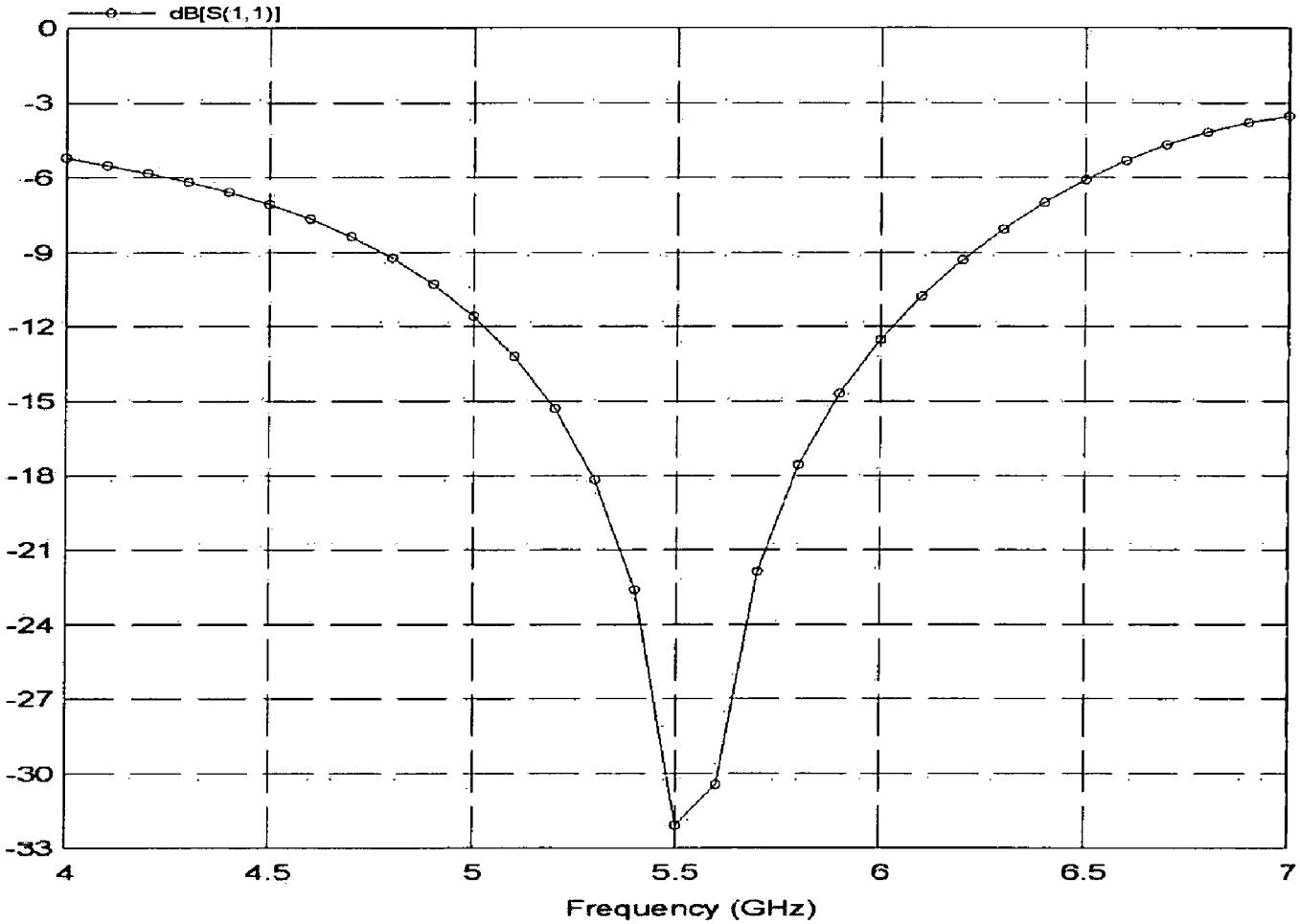
FIG. 6 is the return loss graph of the first embodiment.
Figure 7:
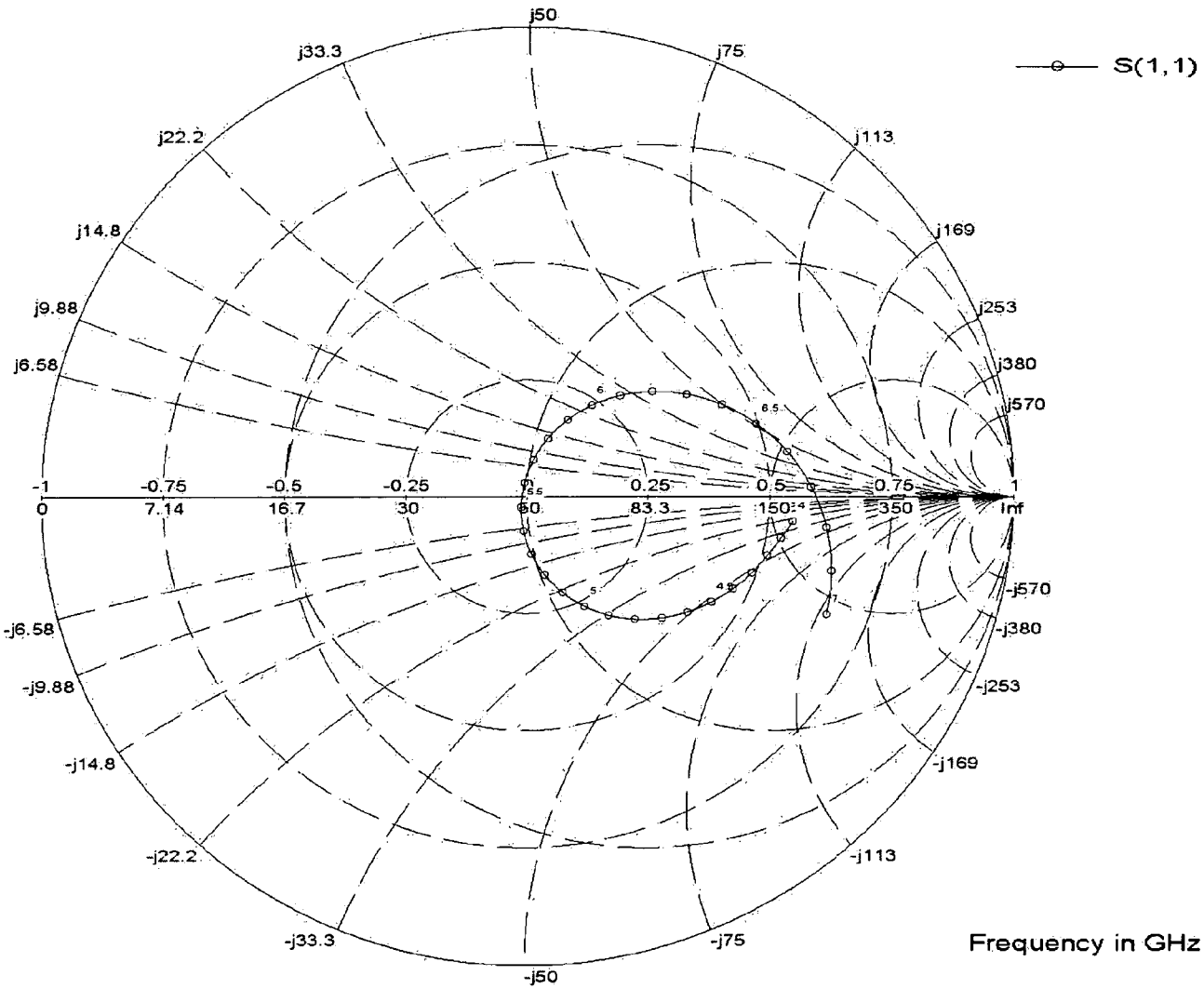
FIG. 7 is the Smith chart of the first embodiment.
Figure 8:
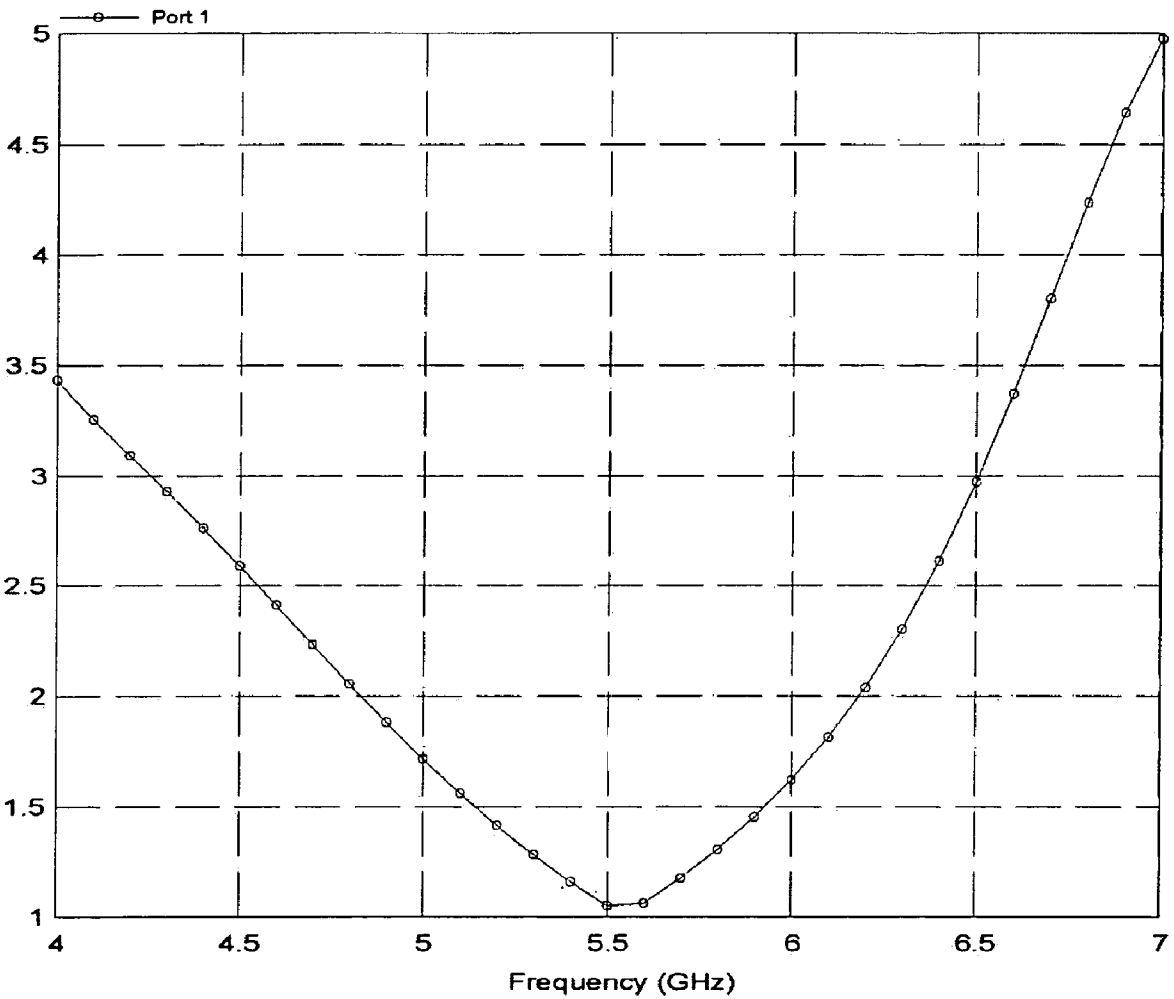
FIG. 8 is the VSWR graph of the first embodiment.

As shown in the return loss graph of FIG. 6, the return loss is about 40.14 dB as the frequency of the antenna is around 5.545 GHz. FIG. 7 shows the Smith chart and FIG. 8 is the VSWR graph of the first embodiment. For the antenna with X-shaped slot-coupled structure, the frequency coverage in 10 dB is about 1,276 MHz or 4.874-6.150 GHz, the frequency coverage of the cover low and middle UNII bands is 5.15-5.35 GHz, the frequency coverage of WRC band is 5.47-5.725 GHz, and the frequency coverage of ISM band is 5.725-5.85 GHz.

Figure 2:
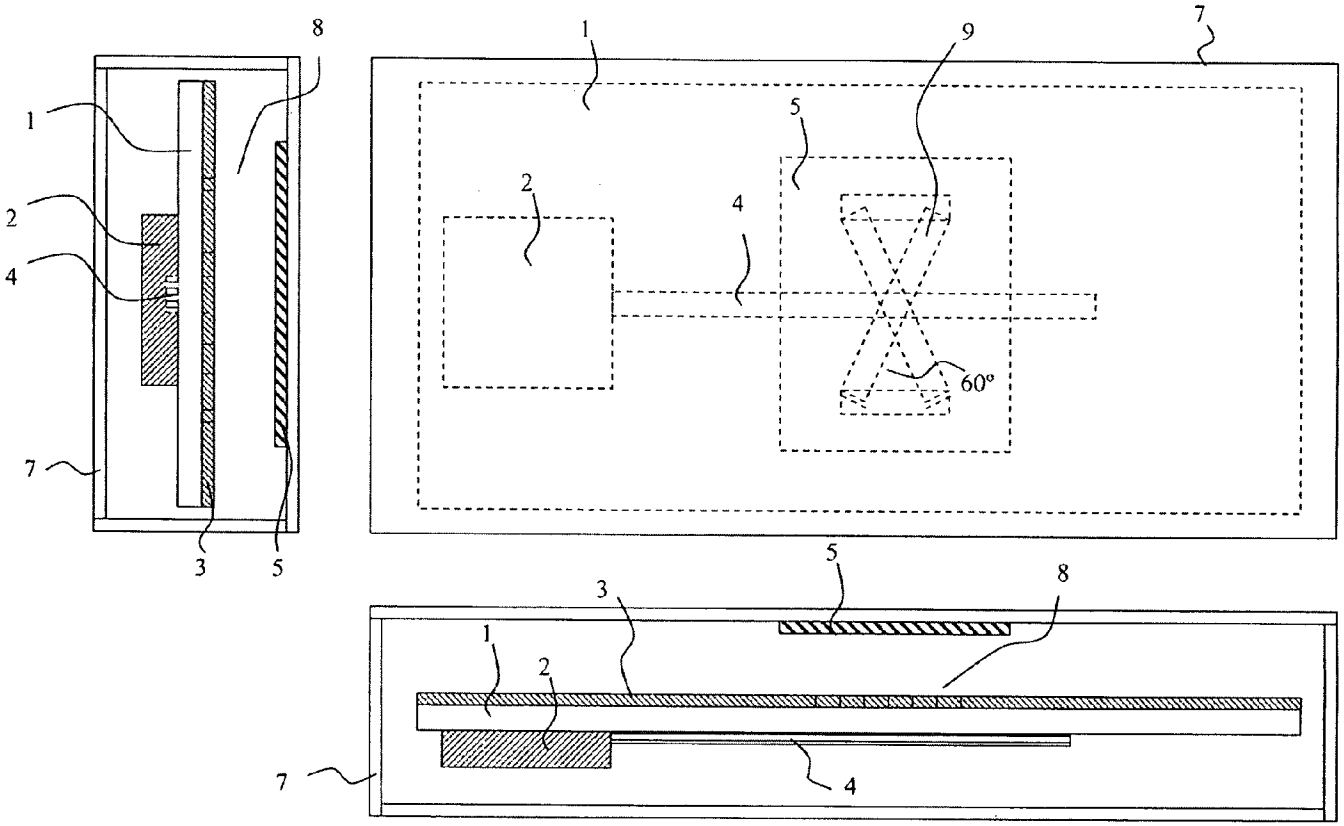
FIG. 2 presents three views of the coupled slot structure according to the second embodiment of the present invention.

FIG. 2 presents three views of the slot-coupled antenna according to one embodiment of the present invention. This embodiment is similar to the above one, so the redundant description would be omitted. The antenna is constituted with dielectric substrate 1, ground plane 3, patch radiator 5, and 8-shaped coupled slot.

As shown in the top view and side view in FIG. 2, the 8-shaped coupled slot 9 is configured on the ground plane 3. Besides, the feed line 4 substantially passes through the intersection point of the 8-shaped coupled slot 9, as shown in the front view in FIG. 2. In general, the feed line 4 is a signal line applied for transferring signals. The patch radiator 5 is coupled to the inner side of the dielectric housing 7 and has the area slightly greater than that of 8-shaped coupled slot 9. In addition, the patch radiator 5 is deposited on the position of 8-shaped coupled slot 9 and usually formed by a conductive plate, such as metal plate. The air stratum 8 between the 8-shaped coupled slot 9 and patch radiator 5 is used as a resonant cavity for communication signals. Since the parameters of the antenna in this embodiment are quite similar to those of the former embodiment, related illustration is omitted.

Figure 9:
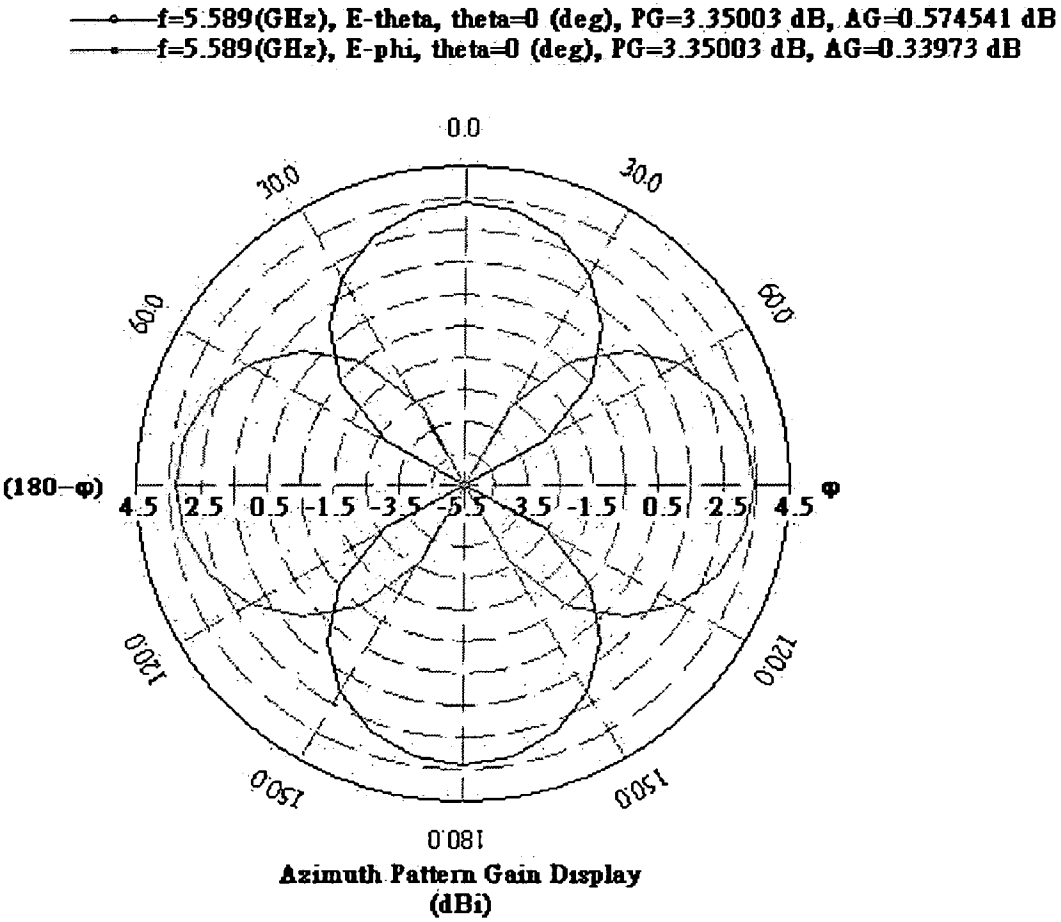
FIG. 9 is the azimuth field pattern of the electric field distribution of the second embodiment.
Figure 10:
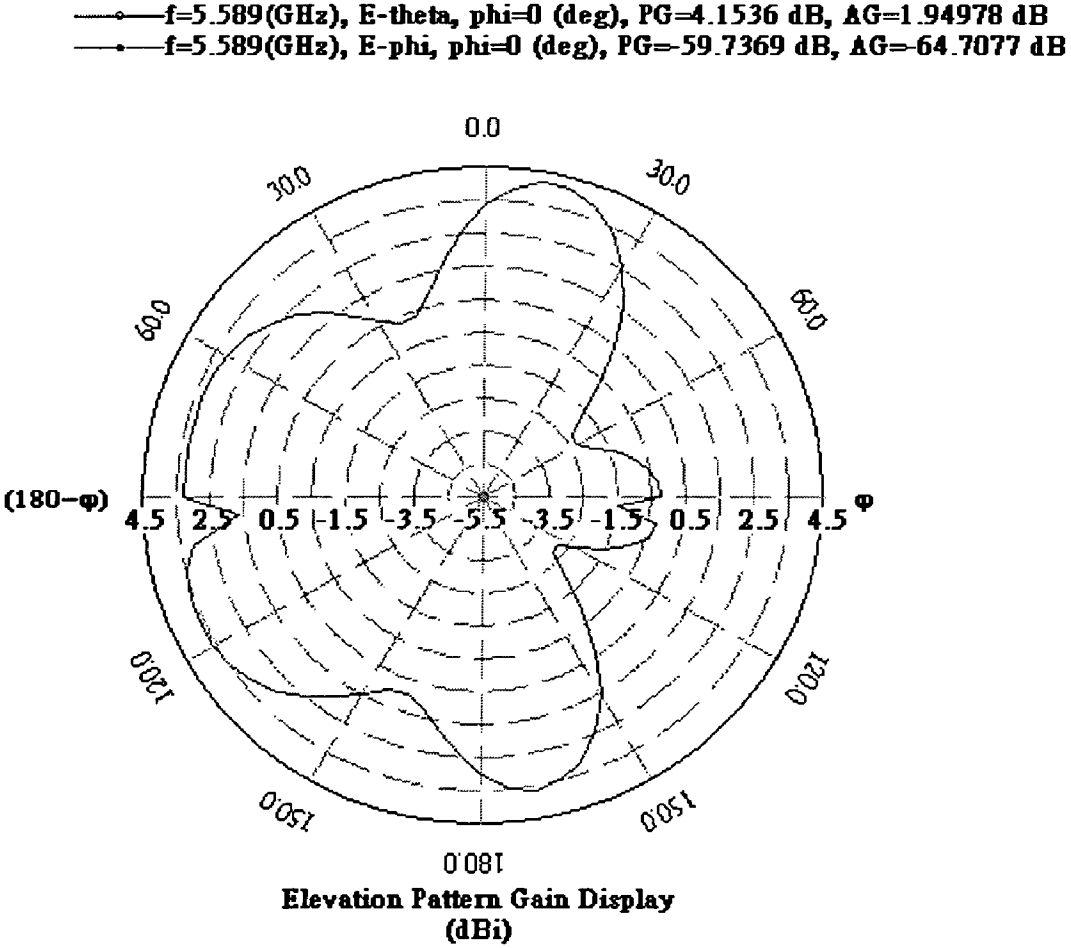
FIG. 10 is the elevation field pattern of the electrical field distribution while ϕ equals 0 of the second embodiment.
Figure 11:
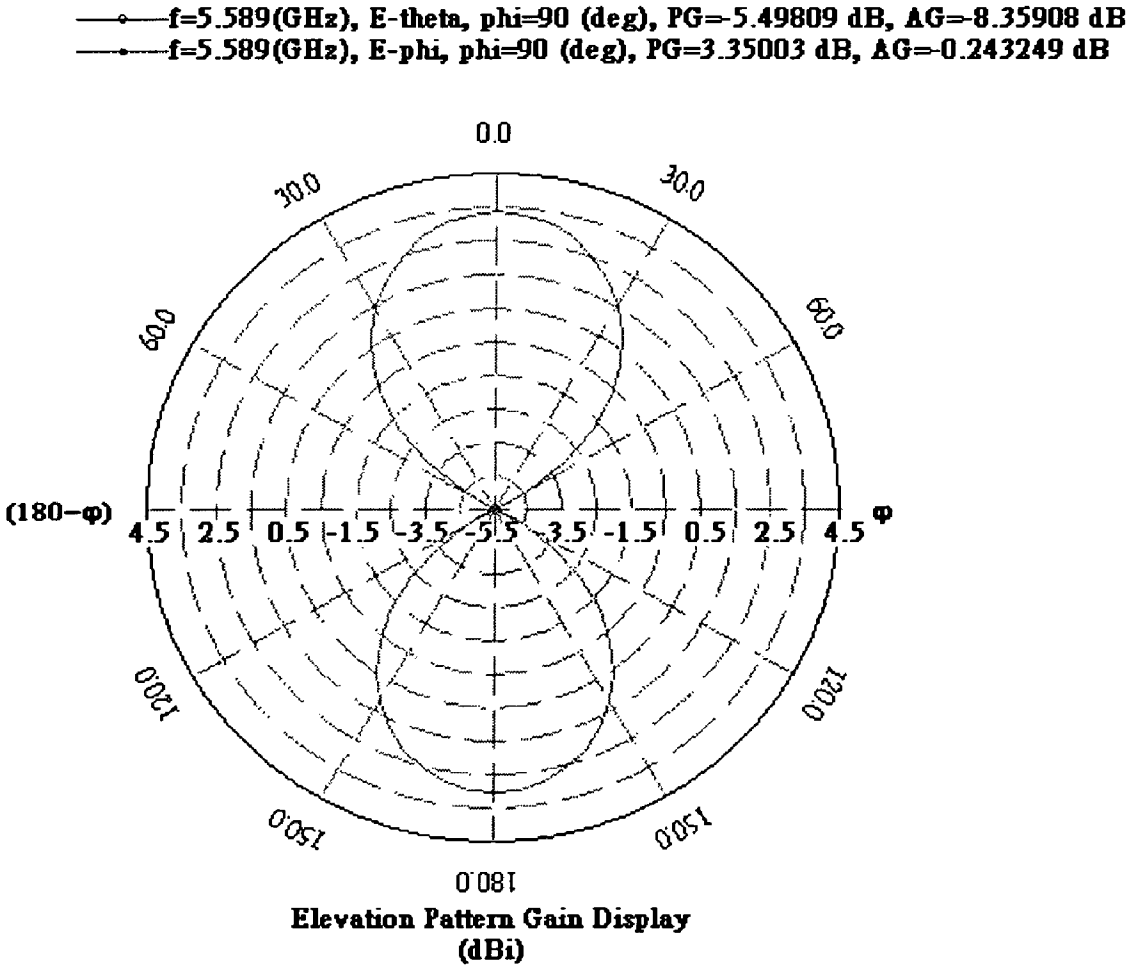
FIG. 11 is the elevation field pattern of the electrical field distribution while ϕ equals 90 degrees of the second embodiment.

FIG. 9 presents the azimuth field pattern of the electric field distribution of the present embodiment. When the angle equals zero, the field pattern would be symmetrical. The peak gain of antenna is 3.35003 dB and the average gain is 0.574541 dB as ϕ of E-theta equals 0. FIG. 10 and FIG. 11 present the elevation field pattern of the electrical field distribution while ϕ equals 0 and 90 degrees. For the present antenna, the peak gain thereof would be about 4.1536 dB when ϕ of E-theta equals 0, and the peak gain thereof would be about 3.35003 dB when ϕ of E-theta equals 90 degrees. Besides, the average gain is about 1.94978 dB as ϕ of E-theta equals 0, and the average gain is about −0.243249 dB as ϕ of E-theta equals 90 degrees.

Figure 12:
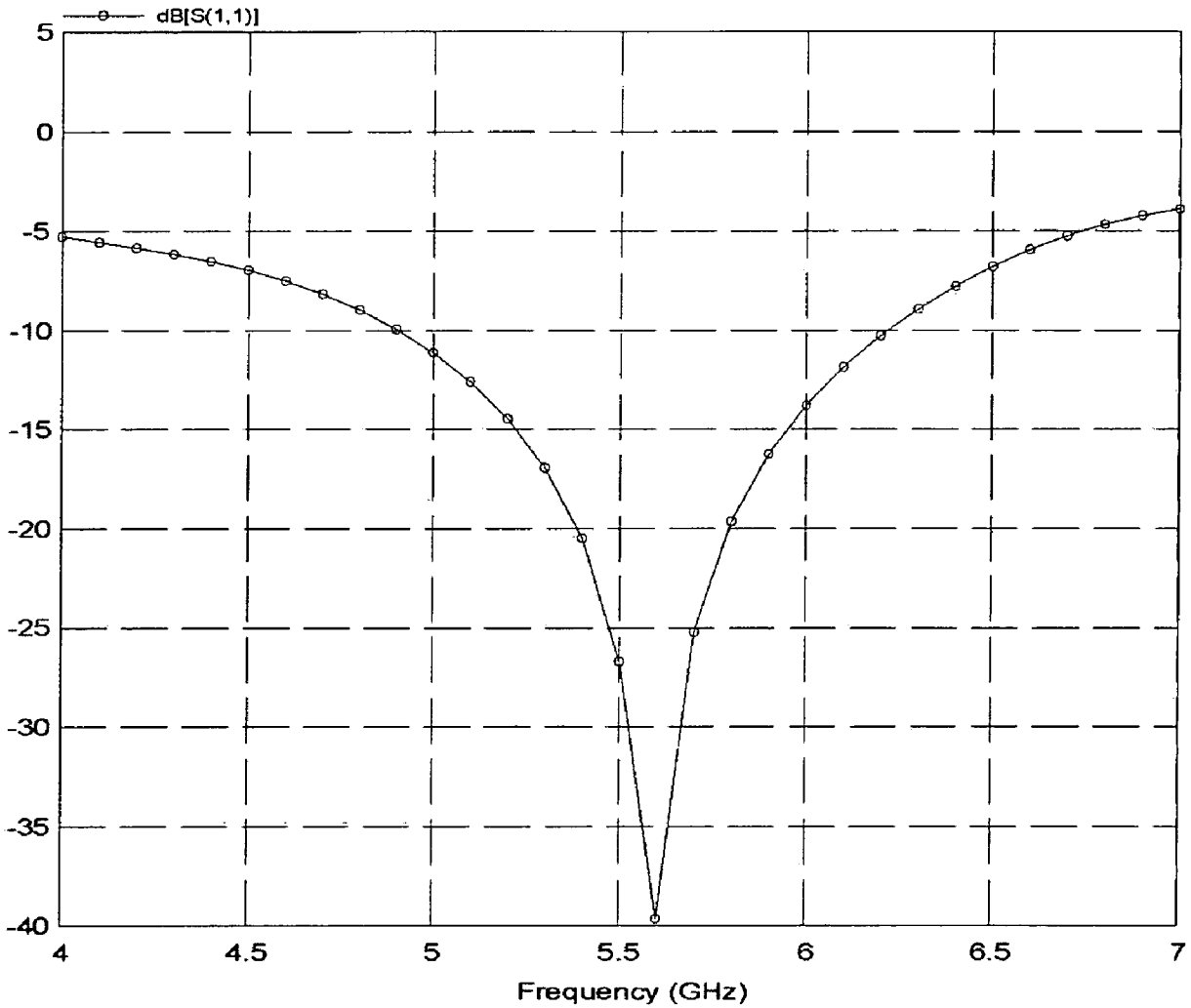
FIG. 12 is the return loss graph of the second embodiment.
Figure 13:
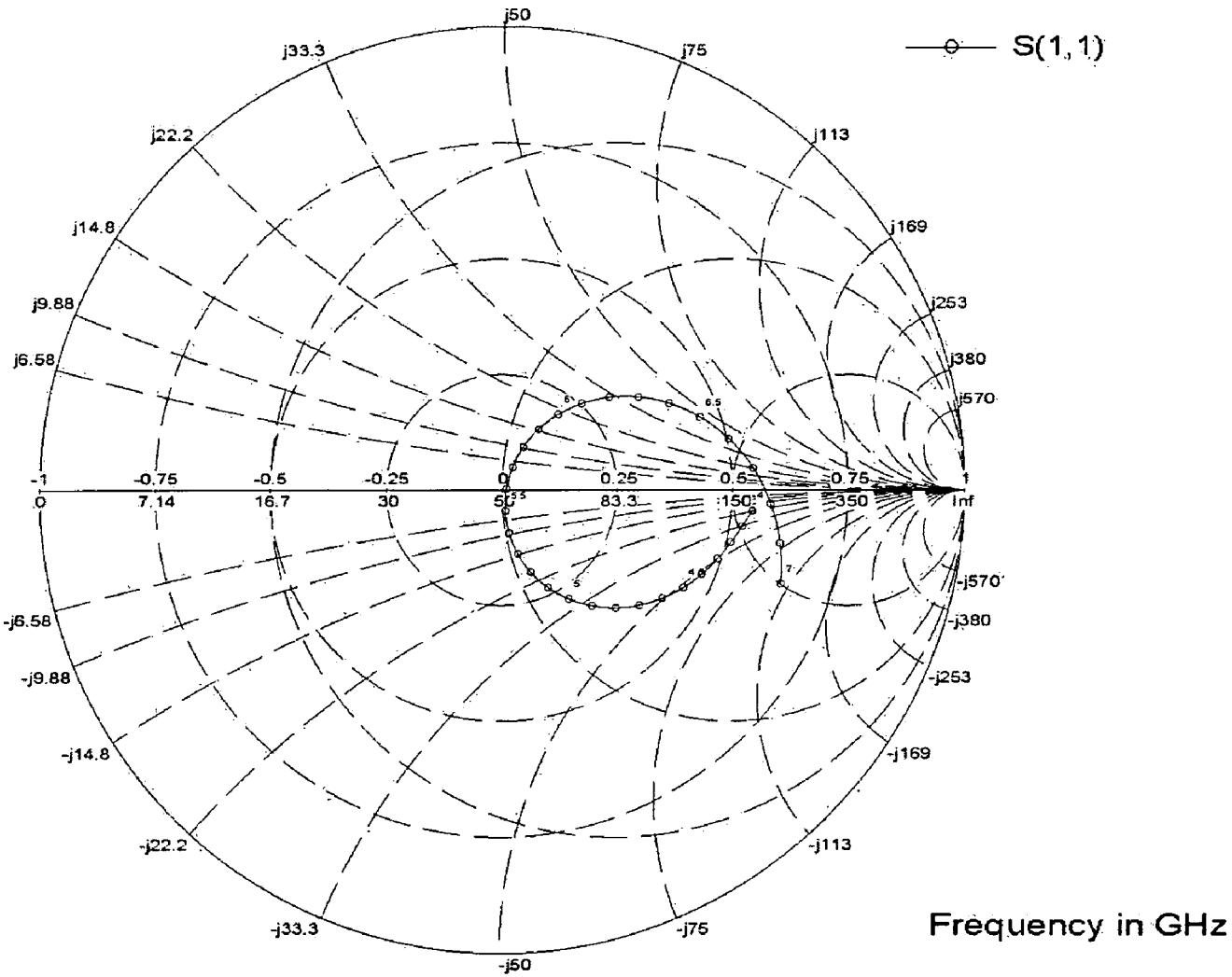
FIG. 13 is the Smith chart of the second embodiment.
Figure 14:
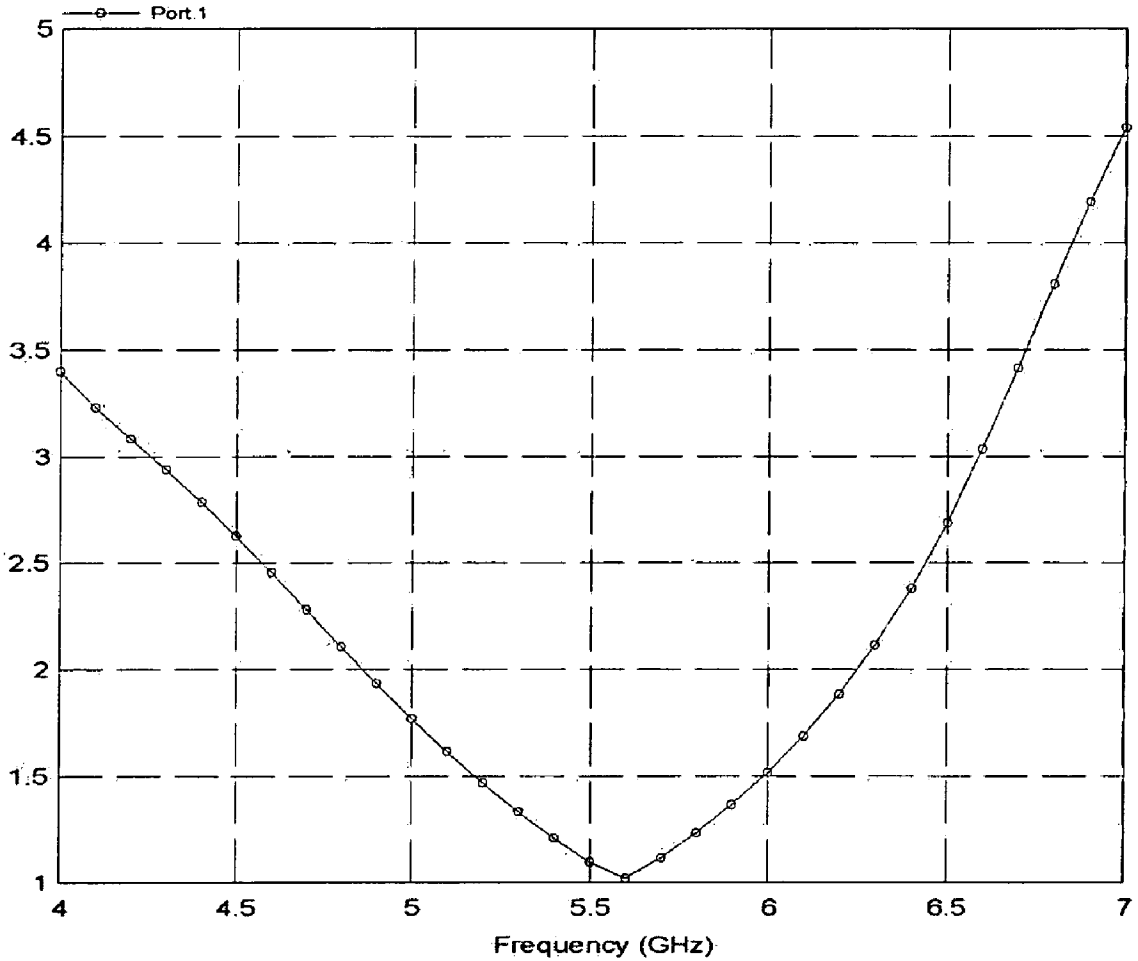
FIG. 14 is the VSWR graph of the second embodiment.

As shown in return loss graph of the present embodiment in FIG. 12, when the frequency of the antenna is 5.589 GHz, the return loss would be about 45.93 dB. FIG. 13 is the Smith chart and FIG. 14 illustrates the VSWR graph of the present embodiment. According to the slot-coupled antenna configuration, the frequency coverage in 10 dB is about 1,322 MHz or 4.902-6.224 GHz, the frequency coverage of the cover low and Middle UNII bands is about 5.15-5.35 GHz, the frequency coverage of WRC band is 5.47-5.725 GHz, and the frequency coverage of ISM band is 5.725-5.85 GHz.

In conclusion, the slot-coupled antenna module is mainly applied in the hand-held or portable communication device, particularly that compatible with WiFi standard and protocols. Since the ground plane of the antenna is provided with a slot-coupled configuration, the disposition flexibility as well as the assembly firmness would be much better than those of prior art. Besides, the slot-coupled antenna of the present invention possesses greater radiation performance as compared with prior art. The X-shaped and 8-shaped slot-coupled configuration could provide wider bandwidth as well as greater return loss than traditional I-shaped slot-coupled configuration. Additionally, the radiation efficiency of the antenna of the present invention is comparable with that of popular H-shaped slot-coupled antenna configuration.

As is understood by a person having ordinary skill in the art, the foregoing preferred embodiments of the present invention are merely provided for illustration rather than limitation. It is intended to cover various modifications and similar arrangements included within the spirit and scope of the appended claims, and the scope of which should be accorded the broadest interpretation so as to encompass all such modifications and similar structure. While the preferred embodiment of the invention has been illustrated and described, it will be appreciated that various changes can be made therein without departing from the spirit and scope of the invention.

I claim:

1. A portable communication device with a slot-coupled antenna module said device comprising:

a radio module on a dielectric substrate within said portable communication device, for processing wireless signals;

a feed line coupled to said dielectric substrate on the same side with said radio module, one terminal of said feed line coupled to said radio module, and other terminal extending substantially toward an long axis of said dielectric substrate;

an X-shaped slot-coupled antenna on said dielectric substrate, wherein said feed line and a stub substantially pass through an intersection point of said X-shaped slot-coupled antenna, and said feed line feeds signals into said radio module;

a ground plane deposited on said dielectric substrate; and a patch radiator, substantially deposited on the position of said X-shaped slot-coupled antenna and parallel with said X-shaped slot-coupled antenna, thereby forming an air gap therebetween as a resonant cavity.

2. The portable communication device as set forth in claim 1, wherein an included angle of said X-shaped slot-coupled antenna is substantially 60 degrees.

3. The portable communication device as set forth in claim 1, wherein said patch radiator includes a metal plate.

4. A portable communication device with a slot-coupled antenna, said device comprising:

a radio module on a dielectric substrate within said portable communication device, for processing wireless signals;

a feed line coupled to said dielectric substrate on the same side with said radio module, one terminal of said feed line coupled to said radio module, and other terminal extending substantially toward an long axis of said dielectric substrate;

an 8-shaped slot-coupled antenna on said dielectric substrate, wherein said feed line and a stub substantially pass through an intersection point of said 8-shaped slot-coupled antenna, and said feed line feeds signals into said radio module;

a ground plane deposited on said dielectric substrate; and a patch radiator, substantially deposited on the position of said 8-shaped slot-coupled antenna and parallel with said 8-shaped slot-coupled antenna, thereby forming an air gap therebetween as a resonant cavity.

5. The portable communication device as set forth in claim 4, wherein an included angle of said 8-shaped slot-coupled antenna is substantially 60 degrees.

6. The portable communication device as set forth in claim 4, wherein said patch radiator includes a metal plate.

7. A slot-coupled antenna module which comprises:

a dielectric substrate;

a feed line coupled to said dielectric substrate on the same side with a radio module, one terminal of said feed line coupled to said radio module, and other terminal extending substantially toward an long axis of said dielectric substrate;

a ground plane, coupled to said dielectric substrate, having an X-shaped coupled slot, wherein said feed line and a stub substantially pass through an intersection point of said X-shaped coupled slot, and said feed line feeds signals into said radio module; and a patch radiator, substantially deposited on the position of said X-shaped coupled slot and parallel with said ground plane, thereby forming an air gap therebetween.

8. The slot-coupled antenna module as set forth in claim 7, which further comprises a dielectric housing for accommodating said slot-coupled antenna module wherein said patch radiator is coupled to an inner surface of said dielectric housing.

9. The slot-coupled antenna module as set forth in claim 7, wherein said dielectric substrate includes a printed circuit board (PCB).

10. The slot-coupled antenna module as set forth in claim 7, wherein said ground plane includes a conductive plate.

11. The slot-coupled antenna module as set forth in claim 7, wherein an included angle of said X-shaped coupled slot is substantially 60 degrees.

12. The slot-coupled antenna module as set forth in claim 7, wherein said patch radiator includes a metal plate.

13. A slot-coupled antenna module which comprises:

a dielectric substrate;

a feed line coupled to said dielectric substrate on the same side with a radio module, one terminal of said feed line coupled to said radio module, and other terminal extending substantially toward an long axis of said dielectric substrate;

a ground plane, coupled to said dielectric substrate, having an 8-shaped coupled slot, wherein said feed line and a stub substantially pass through an intersection point of said 8-shaped coupled slot, and said feed line feeds signals into said radio module; and a patch radiator, substantially deposited on the position of said 8-shaped coupled slot and parallel with said ground plane, thereby forming an air gap therebetween.

14. The slot-coupled antenna module as set forth in claim 13, which further comprises a dielectric housing for accommodating said slot-coupled antenna module wherein said patch radiator is coupled to an inner surface of said dielectric housing.

15. The slot-coupled antenna module as set forth in claim 13, wherein said dielectric substrate includes a printed circuit board (PCB).

16. The slot-coupled antenna module as set forth in claim 13, wherein said ground plane includes a conductive plate.

17. The slot-coupled antenna module as set forth in claim 13, wherein an included angle of said X-shaped coupled slot is substantially 60 degrees.

18. The slot-coupled antenna module as set forth in claim 13, wherein said patch radiator includes a metal plate.

* * * * *